US005413423A

United States Patent [19]

Chou

[11] Patent Number: 5,413,423

[45] Date of Patent: May 9, 1995

[54] PRINT ELEMENT DRIVE CONTROL WITH CONSTANT CURRENT CHARGE AND DISCHARGE OF CAPACITOR

[75] Inventor: Tee-Huang Chou, Taipei, Taiwan, Prov. of China

[73] Assignee: Veri Fone Inc., Redwood City, Calif.

[21] Appl. No.: 216,493

[22] Filed: Mar. 22, 1994

[51] Int. Cl.[6] ..... B41J 2/30

[52] U.S. Cl. ..... 400/157.2; 400/124.02; 361/155; 361/156

[58] Field of Search ..... 400/157.2, 157.3, 166, 400/124.02; 361/152–156; 101/93.03

[56] References Cited

U.S. PATENT DOCUMENTS

| | | | |
|---|---|---|---|
| 3,789,272 | 1/1974 | Vollhardt | 400/121 |
| 4,318,155 | 3/1982 | Thomas | 361/156 |
| 4,514,737 | 4/1985 | Suzuki | 400/121 |
| 4,637,742 | 1/1987 | Sakai | 400/157.2 |
| 4,683,817 | 8/1987 | Del Signore | 400/157.3 |
| 4,735,517 | 4/1988 | Knox | 400/166 |
| 5,032,031 | 7/1991 | Grüner | 400/157.2 |

FOREIGN PATENT DOCUMENTS

| | | | |
|---|---|---|---|
| 114455 | 5/1989 | Japan | 400/157.2 |

*Primary Examiner*—David A. Wiecking
*Assistant Examiner*—Steven S. Kelley
*Attorney, Agent, or Firm*—Lowell C. Berestedt

[57] ABSTRACT

A dot matrix printer having a print head having a plurality of print solenoids. The print head is carried on a print head carriage driven by a carriage drive arrangement. A print timing means supplies a sequence of print timing pulses as said print head traverses a print medium. A power supply supplies a print voltage to the print solenoids in the print head. A drive pulse circuit responds to each of said print timing pulses for producing a solenoid enable pulse of a duration which varies inversely with the magnitude of said print voltage. The drive pulse circuit utilizes a dual slope integration with a first period integrating a fixed voltage for a fixed time and a second period integrating the varying print voltage for a time which varies with the magnitude of the voltage and provides automatic adjustment of the total print timing signal.

11 Claims, 5 Drawing Sheets

SOL_1 to SOL_n BUS
SOL_1
31-1
D_SOL_1
31-2
D_SOL_2
31-8
D_SOL_8
SOL_8
SOL_EN
30
RESET
DRIVE PULSE ADJUST 29
+5
R11
R10
U4
C5
R8
R9
V_D
+V-PRINT
D2
C2
D1
U3
C4
R5
V-REF
+5
V-PRINT
R7
R6
Q2
R4
D3
C3
PULSE

D1
C2
I
V-
Ri
Vi
V+
SOL_EN
U2
V-REF
V-PRINT
+5
C1
Q1
P1
R2
R3
R1
U1
+5
10
TRIGGER

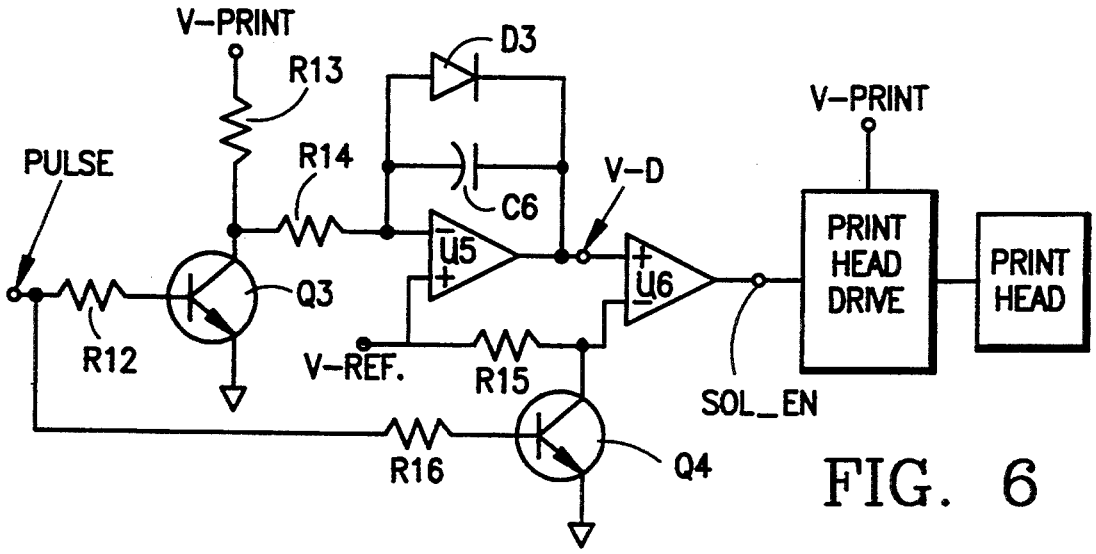
FIG. 6
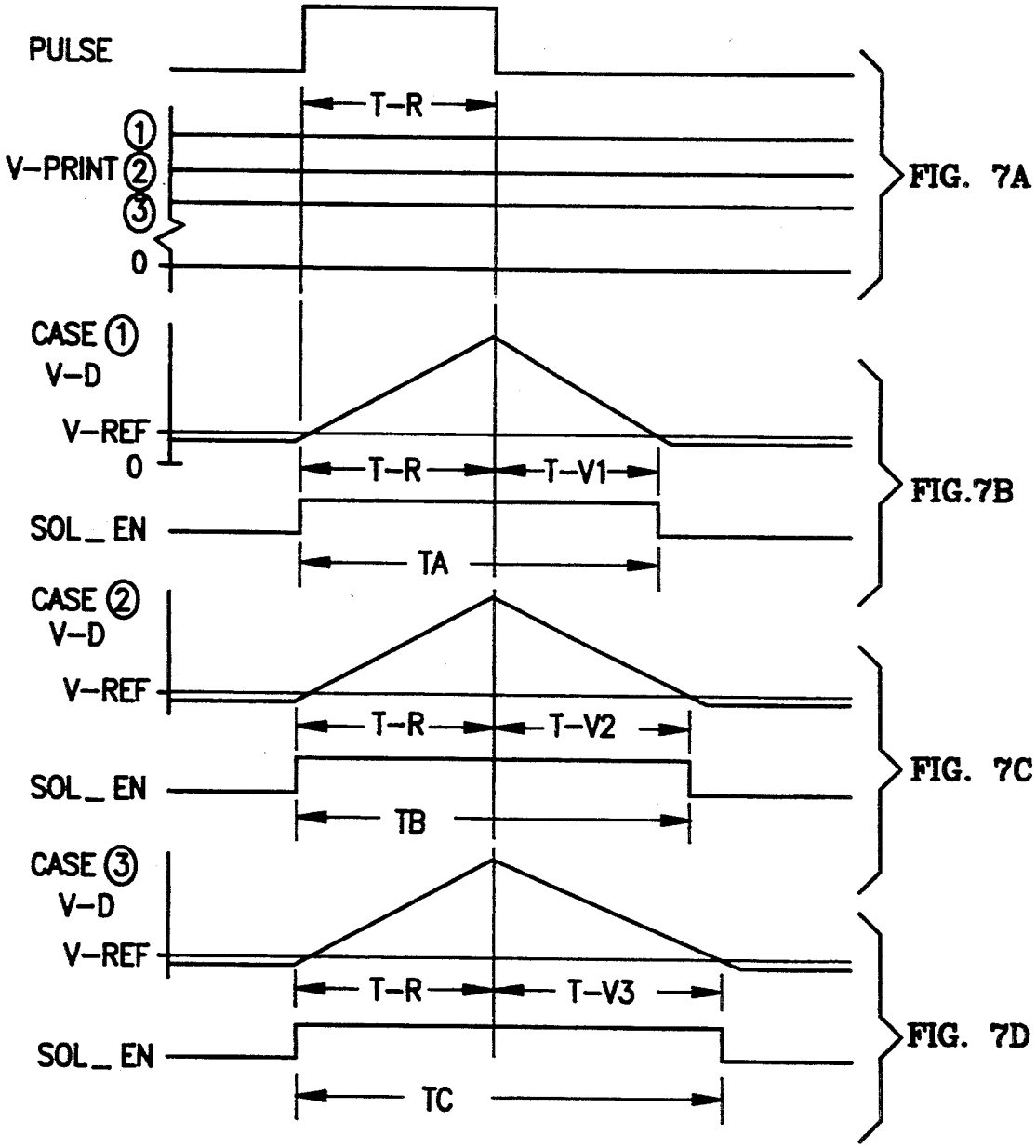

PRINT ELEMENT DRIVE CONTROL WITH CONSTANT CURRENT CHARGE AND DISCHARGE OF CAPACITOR

FIELD OF THE INVENTION

This invention relates generally to apparatus and methods for operating dot matrix printers and, more specifically, to apparatus and methods for supplying drive pulse signals to the print solenoids of a dot matrix print head in which the duration of the drive pulse signals is adjusted to vary inversely with the magnitude of the drive pulse voltage.

BACKGROUND OF THE INVENTION

It is well known in the art of dot matrix printing that the magnitude of the print voltage applied to the solenoids of the print head will vary and the variance depends on both static and dynamic factors. The static magnitude of the print voltage will vary from one DC power supply to another as a result of variations in component values and the degree of regulation against power line voltage fluctuations that is achieved. The main dynamic factor that affects the magnitude of print voltage is the instantaneous load factor, related to the number of solenoids being driven and thus the energy output requirement of the power supply.

Since variations in print voltage supplied to the solenoids will produce corresponding variations in dot print density and thus adversely affect print quality, it has been found necessary to provide automatic and dynamic compensation of the duration of the print drive pulse as a function of the print voltage magnitude. A number of prior art schemes for providing such dynamic compensation have been proposed.

FIG. 1 illustrates one prior art circuit arrangement to achieve such dynamic compensation. a TRIGGER signal of short duration (e.g. eight microseconds) on input terminal 10 is inverted in U1 and coupled through resistor R1 to the base of transistor Q1 to turn Q1 ON to discharge capacitor C1 and to drive the output of comparator U2 HIGH and thus initiate the SOLEN signal. Then when Q1 turns OFF, capacitor C1 begins to charge toward a positive voltage level at a rate dependent on the magnitude of V-PRINT and the overall series resistance value of resistors R2, R3, and P1, and the capacitance value of C1.

When the voltage level across capacitor C1 and thus the voltage on the minus terminal of comparator U2 reaches the level V-REF applied to the plus terminal, the output of comparator U2 goes low and the pulse drive signal SOLEN is terminated. As the magnitude of V-PRINT changes, the length of the SOLEN drive signal is automatically adjusted. A lower V-PRINT magnitude causes C1 to charge more slowly and thus lengthens the duration of the SOLEN signal at the output of U2. Accordingly the duration of SOLEN will vary inversely with the magnitude of V-PRINT. This is the functional relationship that is required to maintain uniform dot print density.

Because of manufacturing tolerances in circuit values, mainly the capacitance value of capacitor C1, it is necessary to adjust the resistance value of potentiometer P1 at the factory to achieve a sufficiently precise control over the relationship between the magnitude of V-PRINT and the duration of the SOLEN output signal.

Other approaches to such automatic compensation of the solenoid drive pulse duration are shown in Vollhardt U.S. Pat. No. 3,789,272 and Suzuki U.S. Pat. No. 4,514,737. While each of these prior art approaches achieves dynamic compensation of the drive pulse duration as an inverse function of V-PRINT voltage magnitude, it is believed that all of them require factory calibration of the circuit, e.g. the resistance value of an RC circuit that performs the timing function.

OBJECTS OF THE INVENTION

It is a principal object of this invention to provide an improved method and apparatus for dot matrix print head operation.

It is another object of this invention to provide an improved method and apparatus for automatic adjustment of solenoid drive pulse duration.

It is a specific object of this invention to provide a method and apparatus for automatic adjustment of drive pulse duration which does not require factory calibration.

FEATURES AND ADVANTAGES OF THE INVENTION

One aspect of this invention features an improved method for supplying a drive pulse signal to a print solenoid drive circuit of a dot matrix printer wherein the duration of the drive pulse signal varies inversely with the magnitude of the print voltage supplied to the print solenoids. This method comprises supplying charge to a capacitor a conerrant current level of prearranged first magnitude during a first timing interval of fixed first duration and then withdrawing charge from the capacitor at a constant current level of a second magnitude varying directly with the magnitude of the print voltage until the voltage across the capacitor reaches a fixed reference level to define a second timing interval of second duration varying inversely with the magnitude of the print voltage. The method also includes supplying a drive pulse signal to the solenoid drive circuit for the combined duration of the first timing interval and the second timing interval.

Another aspect of this invention features a method for operating a dot matrix printer having a print head with a plurality of print solenoids. This method includes carrying the print head across a print medium while producing a sequence of print timing pulses to signal dot print locations and responding to each of the print timing pulses by Supplying to selected ones of the print solenoids a print voltage for a time duration which varies with the magnitude of the print voltage by performing the steps of:

producing a timing pulse of prearranged first time duration in response to the print timing pulse;

charging a capacitor at a constant fixed current for the duration of the timing pulse;

discharging the capacitor at a constant current varying directly with the magnitude of the print voltage until the voltage across the capacitor reaches a fixed reference level, thereby defining a timing interval of a second time duration varying inversely with the magnitude of the print voltage; and supplying the print voltage to the selected solenoids for a time period equal to a prearranged portion of the first time duration and all of the second time duration.

Another aspect of this invention features a dot matrix printer comprising a print head having a plurality of print solenoids, a print head carriage for carrying the print head; and a carriage drive means for driving the print head carriage across a print medium. A print timing means supplies a sequence of print timing pulses as the print head and the carriage traverse the print medium. A power supply means supplies a print voltage for the print solenoids. A drive pulse circuit means responds to each of the print timing pulses to produce a solenoid enable pulse of a duration which varies inversely with the magnitude of the print voltage and a central processing unit responds to each of the print timing pulses to supply a set of individual solenoid address signals corresponding to dots to be printed by the print head. A driver circuit means responds to coincidence of the solenoid enable signal and the solenoid address signals for applying the print voltage to solenoids of the print head associated with the solenoid address signals.

The drive pulse circuit means includes a timing means for providing a first timing interval having a prearranged start time relative to each of the print timing pulses and a prearranged duration. A first circuit means, including a capacitor, responds to the timing means and charges the capacitor in a first direction with a constant current of prearranged fixed magnitude for the duration of the first timing interval and thereafter discharges the capacitor to a first reference voltage of prearranged first magnitude with a constant current of magnitude varying directly with the magnitude of the print voltage to provide a second timing interval of a duration varying inversely with the magnitude of the print voltage. A second circuit means responsive to the first circuit means to produce an output pulse having a duration equal to the combined durations of the first timing interval and the second timing interval to serve as the solenoid enable pulse.

In a preferred embodiment, the timing means is a one shot circuit responding to a trigger signal to produce a pulse output of the prearranged duration and the central processing unit supplies the trigger signal to the one shot circuit at a prearranged time following each of the print timing pulses. In this embodiment the first circuit means comprises:

an operational amplifier having the capacitor and a diode connected in parallel between the output terminal and the minus input terminal of the operational amplifier;

voltage supply means supplying the first reference voltage of the prearranged first magnitude to the plus input terminal of the operational amplifier;

a first resistor means of prearranged first resistance value connected to the minus input terminal;

a second resistor means of prearranged second resistance value connected between the first resistor means and the power supply means to receive the print voltage applied thereto; and switch means coupled to the output of the one-shot circuit and responding to the pulse output by applying a second reference voltage of prearranged second magnitude to the junction of the first and second resistor means for the duration of the pulse output, the prearranged second magnitude of the second reference voltage being less than the prearranged first magnitude of the first reference voltage.

With this circuit arrangement the capacitor is charged for the duration of the pulse output with a current having a magnitude which is a function of the difference between the first and second reference voltages and the first resistance value and the capacitor is thereafter discharged with a current having a magnitude which is a function of the difference between the magnitude of the print voltage and the first reference voltage and the sum of the first and second resistance values until the voltage on the output of the operational amplifier is equal to the first magnitude less the forward voltage drop of the diode.

It will be appreciated that the above methods and apparatus of this invention can readily be implemented using high accuracy resistors (typically 1% accuracy) with accurate resistance values to control the charging and discharging currents and using a standard tolerance capacitor (typically 5% accuracy) without concern about tolerance variations in the capacitor value. Since the circuit operates in a dual slope mode, capacitance value variations equally affect the charging and discharging portions of the operation cycle and offset each other. As a result, fixed values of the components can be used and no factory adjustment of a potentiometer value is required.

Other objects, features and advantages of this invention will be apparent from a consideration of the following detailed description of various embodiments of the invention in conjunction with the accompanying drawings.

BRIEF DESCRIPTION OF DRAWING FIGURES

FIG. 6 is a circuit schematic diagram of an alternative embodiment of a drive pulse adjust circuit in accordance with this invention.

FIGS. 7A–7D are waveform diagrams showing the operation of the circuit of FIG. 6 for different cases of V-PRINT voltage magnitude.

DESCRIPTION OF INVENTION EMBODIMENTS

Figure 2:
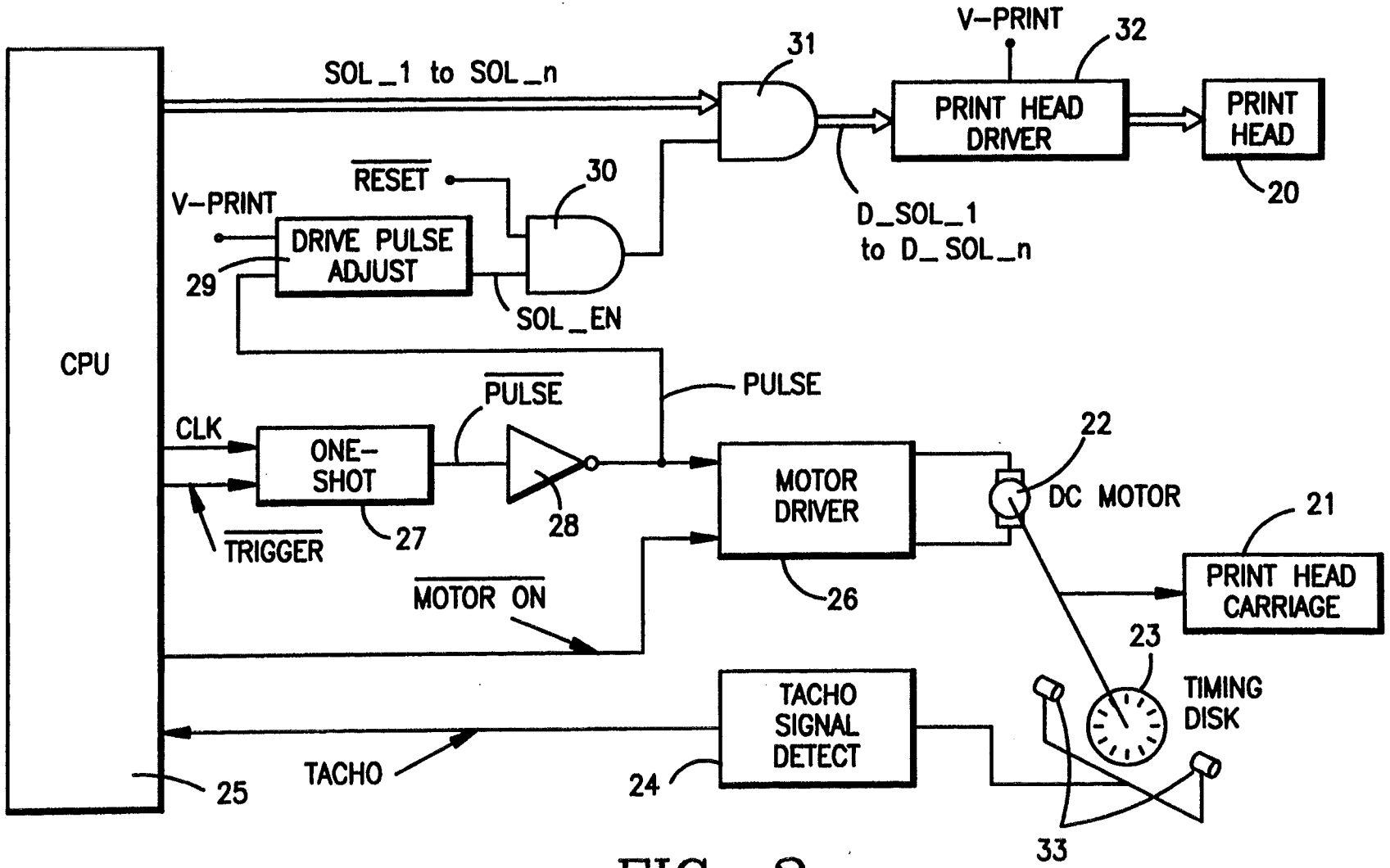
FIG. 2 is a block diagram of a dot matrix printer control arrangement in accordance with this invention.

Referring to FIG. 2, a print head 20 of a dot matrix printer is typically carried on a print head carriage 21. Carriage 21 is driven across a print medium by a DC motor 22. The typical motor drive arrangement for the carriage is a lead screw drive (not shown). Timing disk 23 mounted on the shaft of DC motor 22 together with a photodetector arrangement 33 and tacho signal detect circuit 24 provides a signal pulse train from which both carriage velocity and position information can be determined. The output of tacho signal detect circuit 24 is a TACHO pulse waveform having the characteristics shown in FIG. 3. This TACHO pulse waveform is utilized as an interrupt signal to CPU 25. Each negative going transition of that waveform is recognized as an interrupt.

Timing disk 23 and DC motor 22 and related carriage drive transmission elements (not shown) are constructed and arranged such that the TACHO signals can be utilized to signal individual dot print positions within a character printing cell. A typical cell involves a 10×8 dot array with an 8×8 dot matrix per character for normal text. Accordingly, ten TACHO pulses are associated with each character cell. CPU 25 keeps track of carriage position with the help of a home position detector (not shown). CPU 25 responds to each TACHO pulse which represents a dot print position, by outputting solenoid address signals on control signal bus SOLI to SOLn. This control signal bus is fed to an AND-gate arrangement 31 to control which specific set of the n solenoids (typically eight) in print head 20 are to be fired at that dot print position.

Figure 3:
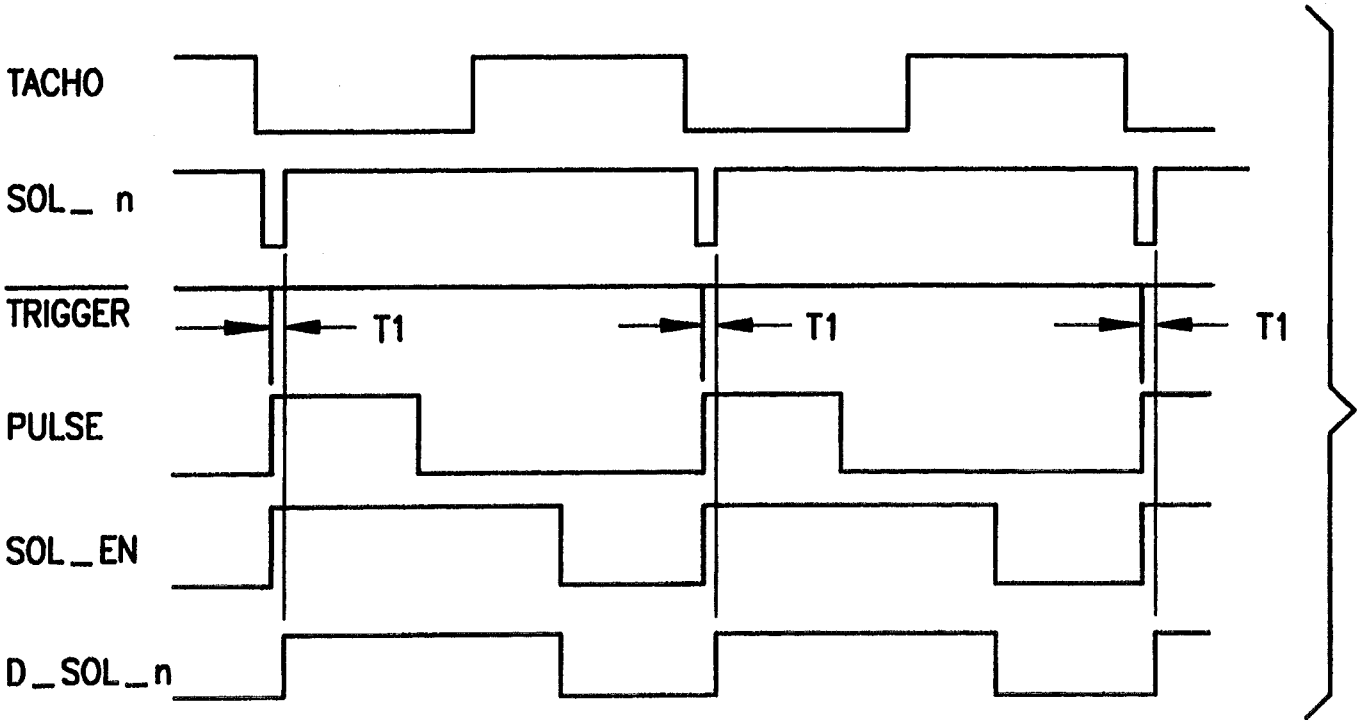
FIG. 3 is a series of pulse timing diagrams showing the basic operation of the control arrangement of FIG. 2.

As shown in FIG. 3, a predetermined time after each TACHO signal (HIGH to LOW transition), CPU 25 sends a/TRIGGER signal to one-shot circuit 27 which, in turn, produces a/PULSE output to inverter 28 whose inverted output is the PULSE waveform shown in FIG. 3. This PULSE output is coupled to motor driver circuit 26 which also receives motor ON-OFF control signals from CPU 25 via a/MOTOR-0N lead. The motor driver control arrangement is not a part of this invention and will not be described in detail here. In general, motor driver 26 utilizes the frequency of PULSE input signals as an indication of the velocity of DC motor 22 and performs a velocity control function on drive signals to the motor to maintain motor velocity and thus carriage velocity within acceptable limits.

The PULSE signal is also coupled to drive pulse adjust circuit 29 which produces a solenoid enable output pulse, labeled SOLEN, as one input to AND-gate 30. The other input to AND gate 30 is a /RESET input which an output from a watchdog circuit (not shown). The protective function of such a watchdog circuit is well known in this art and will not be described here. Under normal operating conditions,/RESET is HIGH (TRUE) and thus AND-gate 30 is fully enabled when SOLEN is HIGH.

Figures 1, 4, 4A:
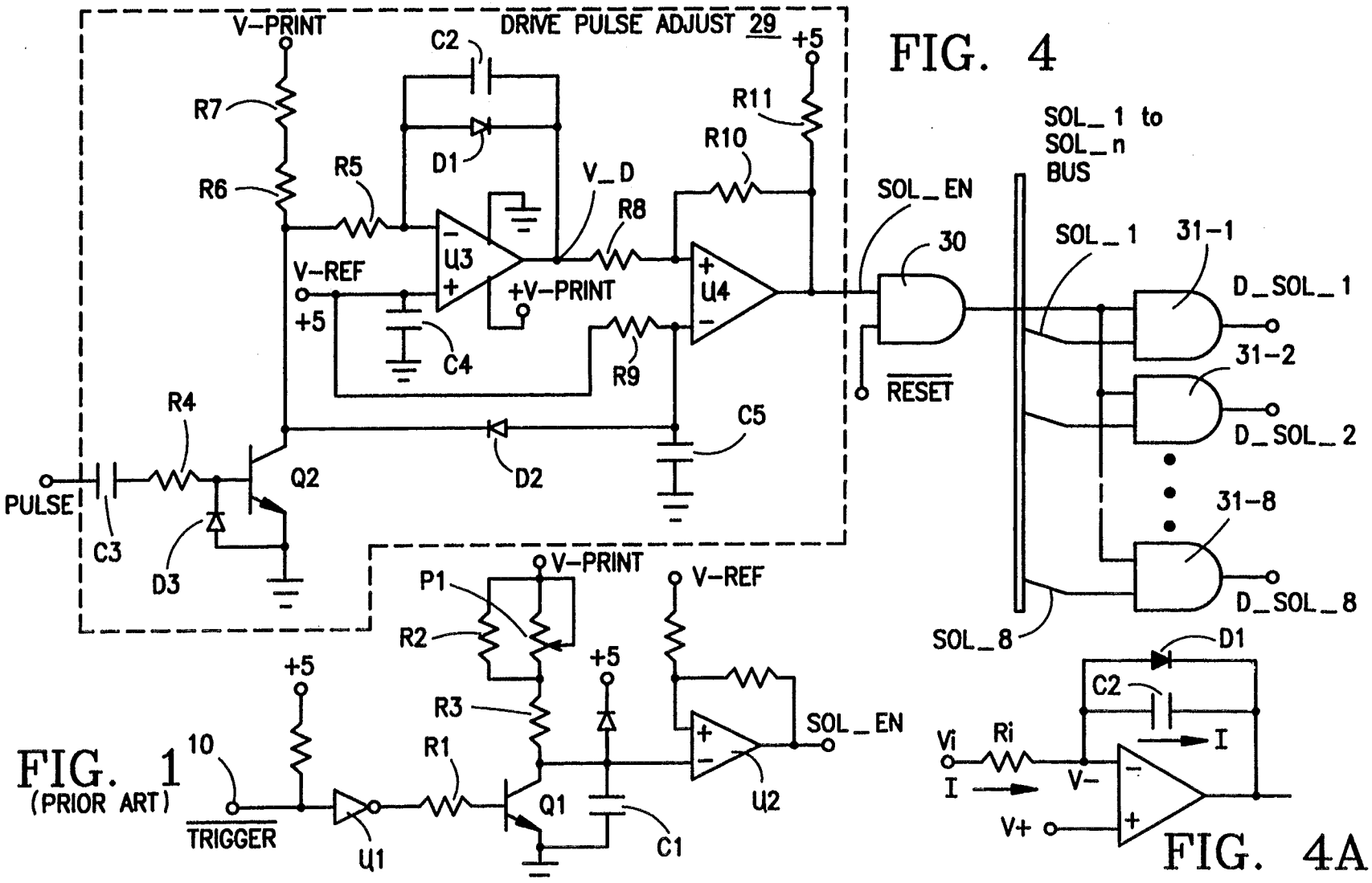
FIG. 1 (PRIOR ART)
FIG. 1 is a schematic diagram of a prior art drive pulse adjustment circuit.
FIG. 4 is a circuit schematic diagram of a preferred embodiment of a drive pulse adjustment circuit in accordance with this invention.
FIG. 4A is a simplified circuit schematic diagram of an op amp integrator circuit useful in explaining the constant current operation thereof.

This SOLEN signal, which is passed through AND-gate 30 under normal conditions, is one input to AND-gate arrangement 31 shown in more detail in FIG. 4 and controls the timing of operation of print head driver circuits 32 which, in turn, operatively drive associated solenoids in print head 20. The outputs of AND-gate arrangement 31 are separate control signal leads DSOL1 to DSOLn (see FIG. 4), each of which is associated with one of the solenoids in print head 20. The basic concept of this control scheme is that the signals on the address bus lines SOL1 to SOLn determine which subset of the n solenoids will be driven to print a dot on the medium at the instant print position and the SOLEN signal controls the duration of the solenoid drive signal.

Within this basic concept, it should be understood that either of the two signals can control the starting time of the solenoid drive signal, but the SOLEN signal always effectively controls the duration of the drive signals to the solenoids.

In the timing diagrams shown in FIG. 3, the SOLEN signal produced in response to the PULSE signal goes HIGH before the SOLn address signal goes HIGH. However, the time T1 between the/TRIGGER signal which controls the start of the PULSE signal is constant from one TACHO signal to another. This constant relationship is determined by the firmware routines running in CPU 25 and this assures that the duration of the SOLEN signal accurately controls the duration of the drive signals DSOLn to the solenoids. It should be understood that the firmware control routines could also be constructed such that the/TRIGGER signal and thus the PULSE signal both occur a short time after the SOLn signal goes HIGH.

It should also be understood that a firmware routine in CPU 25 could be employed to produce the PULSE input to drive pulse adjust circuit 29 instead of using one-shot circuit 27. The same timing considerations would attache to this alternative arrangement. The PULSE signal must start a prearranged time after the TACHO signal produces the CPU interrupt and must have an accurately timed duration.

As will now be described in connection with FIGS. 4 and 5, in accordance with this invention, the duration of the PULSE signal is fixed, but a drive pulse adjust circuit of this invention responds to the PULSE signal to produce a SOLEN signal with a duration that varies inversely with the magnitude of the V-PRINT signal.

Referring to FIG. 4, operational amplifier (op-amp) integrator U3 is arranged with capacitor C2 and diode D1 connected in parallel between its minus input terminal and its output terminal, labeled V-D. The plus input terminal of op-amp U3 is connected to a stable reference voltage V-REF (+5 volts, for example). Capacitor C4 is connected between the plus input terminal and ground to provide noise filter protection for that input terminal. The minus terminal is connected via resistors R5, R6 and R7 to an input voltage terminal supplied with the V-PRINT voltage.

The junction of resistors R6 and R5 is connected to the collector of NPN transistor Q2. The emitter of Q2 is connected to ground potential and the base of Q2 is connected via an input protection resistor R4 and capacitor C3 to an input terminal that receives the pulse input. This AC coupling of the PULSE signal into the base of transistor Q2 protects the drive pulse adjust circuit against the possibility of the PULSE signal being stuck in a HIGH state. Diode D3 provides a discharge path for capacitor C3 so that transistor Q2 will be turned on only for the duration of the PULSE signal, i.e. the period of time that the PULSE signal is HIGH.

The V-D signal output of op-amp integrator U3 is connected through protection resistor R8 to the plus input terminal of comparator amplifier U4. The minus terminal of comparator U4 is connected via protection resistor R9 to the V-REF voltage and via capacitor C5 to ground potential for noise protection and, finally, via diode D2 to the collector of transistor Q2. This last recited connection enables transistor Q2 to operate as a switch to apply ground voltage to both the junction of R6 and R5 and to the minus input of comparator U4 when Q2 is ON, while isolating the minus input of comparator U4 from the positive voltage on the collector of Q2 when Q2 is OFF. Resistor R11 serves as a pull-up resistor on the open-collector output of comparator U4 and resistor R10 provides a small amount of hysteresis voltage to increase the noise immunity of the comparator circuit.

The output of comparator U4 is the SOLEN signal and provides one input to AND-gate 30, the other input being/RESET as previously explained. The output of AND-gate 30 is one input in common to each of the AND-gates 31-1 to 31-8. The other inputs to AND-gates 31-1 to 31-8 are the solenoid address signal bus lines SOL1 to SOLn, where n is equal to 8 in this case. The outputs of the AND-gates 31-1 to 31-8 are the DSOL1 to DSOLn control signals to the print head drivers circuits (not shown).

Examples of component types and values for use in the drive pulse adjust circuit of FIG. 4 are given in Table I.

TABLE I

| | |
|---|---|
| Resistors (5% unless indicated, value in ohms) | |
| R4, R8, R9, R11 | 10K |
| R5 (1%) | 68.1K |
| R6 (1%) | 221K |
| R7 (1%) | 1K |
| R10 | 2M |
| Capacitors (10% unless indicated) | |
| C2 (5%) | 1000 picofarad |
| C3, C4 | 0.1 microfarad |
| C5 | 1800 picofarad |
| Diodes all D1N4148MELF | |
| Transistor Q1: | 2N3904SM |
| Operational Amplifier U3: | LM358SMV+ |
| Comparator: | LM393SMV+ |
| V-REF: | 5 Volts (1%) |

The operation of drive pulse adjust circuit 29 shown in FIG. 4 will now be described with reference to the pulse and waveform diagram in FIG. 5 and the general block diagram of FIG. 2. Specific time durations will be mentioned as an example of one set of operating conditions and parameters. It should be understood that the invention is in no way limited to any specific parameters.

First, the general operation of the op-amp integrator U3 will be discussed relative to the diagram of FIG. 4A. The general equation for the constant current operation is as follows:

$$I=(Vi-V-)\,/\,Ri$$

where

I is the current flowing through the resistor Ri to charge the capacitor C2,

Vi is the input voltage,

Ri is the input resistance, and with the understanding that, due to the operation of U3, V− = V+

The initial operating conditions are:

a. PULSE is LOW so transistor Q2 is OFF. Diode D1 is conducting so no current is fed to capacitor C2.

b. the voltage on the minus terminal of op-amp integrator U3 will be the same as the voltage on the plus terminal: i.e. 5 volts, and the output terminal of op-amp integrator U3 is clamped by diode D1 at 4.5 volts, i.e. VD=4.5 volts.

c. capacitor C2 has a static charge equal to one diode drop (0.5 volts), the output of comparator U4 is ON because the voltage on its minus terminal (5 volts) is higher than the voltage on its plus terminal (4.5 volts) and consequently SOLEN is LOW.

Following receipt of a TACHO pulse interrupt, CPU 25 terminates the current address signals on the SOLn bus and thereafter outputs a /TRIGGER pulse at time TA. The /TRIGGER signal is a low active pulse of 3.62 microsecond duration and it triggers one-shot circuit 27 at time TA. One-shot circuit 27 produces a low active signal, labeled/PULSE, with duration of 188.82 microseconds, and this /PULSE signal is inverted in inverter 28 to the PULSE signal shown in FIG. 5.

This PULSE signal coupled to the base of transistor Q2 turns 02 ON (in saturation) and puts ground reference potential on the collector electrode of Q2 (neglecting small saturation voltage of 27 millivolts). Diode D2 couples this ground potential to the minus terminal of comparator U4, causing U4 to turn ON and its output SOLEN to go HIGH. All of this occurs at time TA.

With ground potential on the junction between resistors R5 and R6, op-amp integrator U3 begins supplying a constant charging current I-TA to capacitor C2 and the value of this current is (using the formula above):

$$I\text{-}TA=(0-V\text{-}REF)/R5$$

In our example, V-REF is 5 volts and R5 is 68.1K, so I-TA is calculated as - 73.4 microamps. With this charging current the voltage on output terminal VD of op-amp integrator U3 rises at a constant rate as shown in FIG. 5.

When the PULSE signal goes LOW after 188.82 microseconds, transistor Q2 turns OFF, and op-amp integrator 133 reverses the constant current to capacitor C2 and this new constant current I-TC has a value (using the formula above):

$$I\text{-}TC=(V\text{-}PRINT-V\text{-}REF)/(R5+R6+R7)$$

Assuming V-PRINT is 25.5 volts and with V-REF at 5 volts and using the resistance values from Table I, the value of I-TC is $$I\text{-}TC=(25.5-5)/(68.1K+221K+1K)$$

or $$I\text{-}TC=20.5/290.1K=70.7 \text{ microamps}$$

Figure 5:
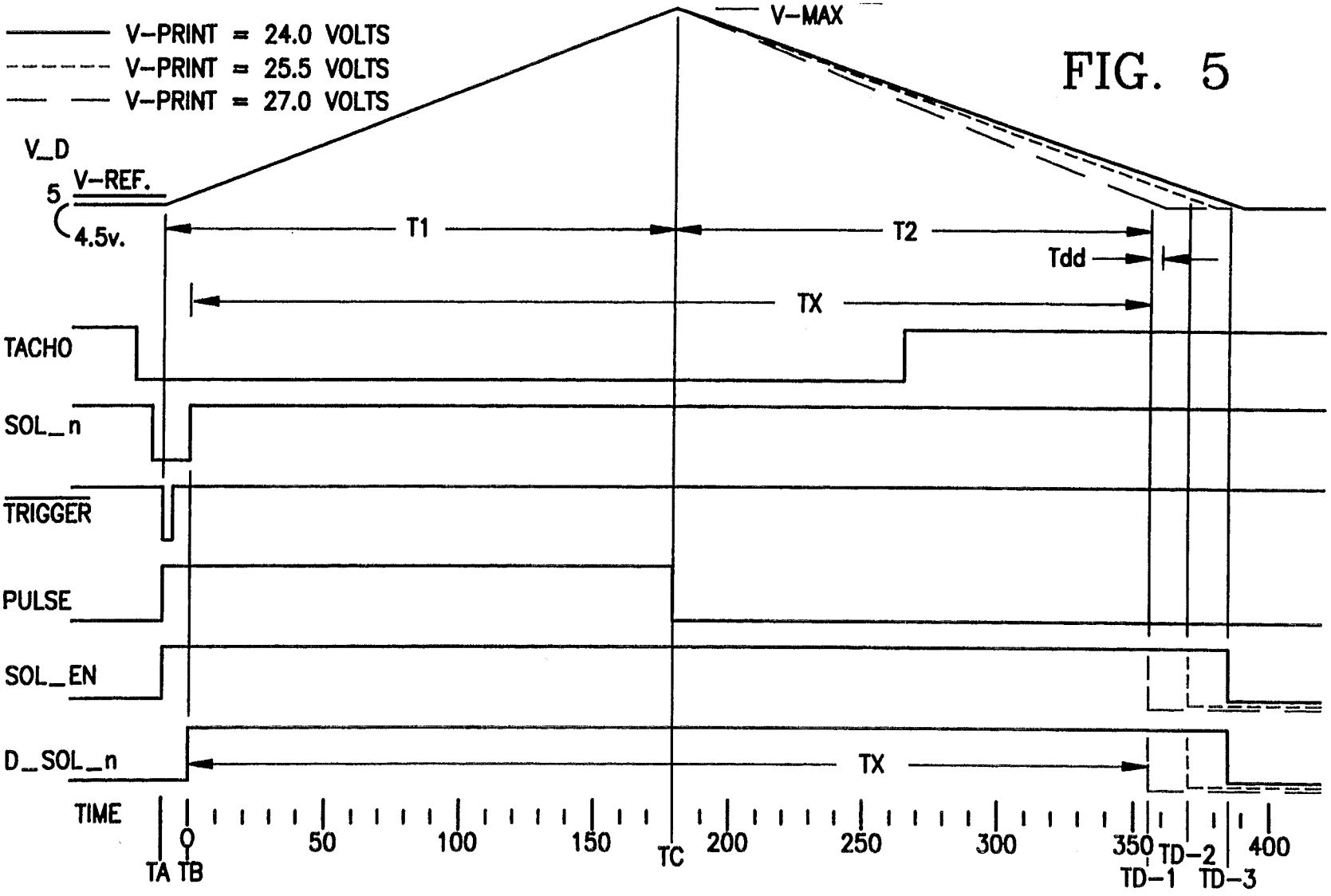
FIG. 5 is a pulse and voltage waveform diagram showing details of the operation of the circuit of FIG. 4.

Accordingly, after time TC in FIG. 5, the voltage at output terminal VD of op-amp integrator declines at a constant rate and the output SOLEN of comparator U4 will go LOW as soon as the voltage declines to a value equal to V-REF or +5 volts in this case. This occurs at a time TD.

It will thus be apparent that the rate of decline of the voltage on terminal VD and thus the duration of the time period between time TC and time TD that comparator U4 will have HIGH output depends on the value of V-PRINT. For lower values of V-PRINT, the rate of decline of the voltage on VD decreases and thus the total time that SOLEN is HIGH increases. Three different rates and three different termination times of SOLEN, TD-1, TD-2, and TD-3, are shown in FIG. 5.

The advantage of this dual slope integration in accordance with this invention will now be explained. A capacitor being charged with a constant current will accumulate a stored charge at a rate dependent on the capacitance value of the capacitor. As is well known, the capacitors with highly accurate capacitance values (e.g. within plus or minus one percent from unit to unit) are expensive. Inexpensive capacitors of the type usually used in electronic circuit manufacture will have plus or minus ten percent variance in capacitance value from the nominal value. If a single direction of charge of a capacitor and the resulting voltage change are used for timing control, as in the prior art circuit of FIG. 1, then a potentiometer trimming operation is required to achieve accurate timing interval control. The circuit board has to be put into a tester and the potentiometer adjusted until the pulse duration output at different V-PRINT voltages meets the print head specification.

The dual slope integration performed in the circuit of this invention eliminates any need to use a potentiometer to trim resistor values to adjust for differences in capacitance values. Instead, the component values which will give the needed variation in time duration of SOLEN with magnitude of V-PRINT voltage can be calculated. The manufactured circuit will then respond to V-PRINT variations to produce a SOLEN signal of the needed duration for uniform dot matrix printing.

The theory behind this result will now be explained. The amount of charge placed on capacitor C2 while integrating with constant current in one direction between time TA and time TC is essentially equal to the amount of charge removed from capacitor C2 while integrating with constant current of opposite sign between time TC and time TD because the voltage change on the capacitor is essentially the same in both directions.

The change in the amount of charge Q on C2 is given by this general equation:

$$Q=I*T$$

where I is the constant current value, and

T is the duration time of the constant current.

Thus, the equation for charge added to C2 during time Ti is $$Q1=I1*T2$$

and the equation for charge removed from C2 during time T2 is $$Q2=I2*T2.$$

If Q1 and Q2 were equal (i.e. if we ignore the small difference due to difference between 4.5 volt starting point for T1 and 5 volt ending point for T2), then $$I1*T1=I2*T2.$$

Since I1, T1, and I2 are all known quantities, as described or calculated above, the value of T2 can be determined by $$T2=[I1*T1]/I2$$

However, for accuracy we need to take into account this difference in start and end voltages and express the equation thusly:

$$T2=Tdd=[I1*T1]/I2$$

where Tdd is the small time period after time TD required for the voltage VD to decline from the 5.0 volt level at which comparator U4 is triggered to the clamped level of 4.5 volts.

Tdd is calculated using these basic equations:

$$Q=C*V$$

$$Q=I*t$$

$$\text{so } I*t=C*V$$

$$\text{or } t=(C*V)/I$$

where Q is the charge accumulated on the capacitor

V is the change in voltage across the capacitor due to accumulated charge

I is the constant charging current t is the time duration of the constant current Using the calculated value of I as I-TC=70.7 microamps, with the values for C and V, we get $$Tdd=(1000 \text{ picofarads}*0.5 \text{ volts})/70.7 \text{ microamps}$$

$$Tdd=7.07 \text{ microseconds.}$$

While the capacitance value of C is used in calculating this adjustment time value, the amount of error due to variations in the capacitance value are small and can be ignored.

Now, plugging the calculated value for Tdd into the equation above, we get the following:

$$T2=([I1*T1]/I2)-Tdd$$

$$\text{or } T2=([73.4*188.9)]/70.7)-7.07$$

$$\text{or } T2=189.03$$

Since the time from TA to TB is 9.05 microseconds, we have the equation for TX as $$TX=T1+T2-9.05$$

$$\text{or } TX=188.9+189.03-9.05$$

$$\text{or } TX=368.88 \text{ microseconds}$$

This is still a simplified explanation of the calculations involved since it ignores the effects of some components, for example the collector-emitter saturation voltage of Q2 (27 millivolts), and the input offset voltages of op-amp U3 and comparator U4. A more complex calculation is actually involved in the circuit design process, but the details of this more complex calculation will be apparent to persons skilled in this art and need not be set forth here.

In actually designing a circuit to meet the specification for a print head, one begins with the manufacturer's specification for drive pulse duration at different V-PRINT voltages and then calculates the duration of T1 and other values for the circuit that will produce the needed relationship between V-PRINT values and SOLEN values. The values for one shot period T1 and the resistance values of R5, R6, R7 are adjusted so that the correct amount of variation in the duration of T2 with the magnitude of V-PRINT will be produced. This process also takes into account that the manufacturer specifies the drive pulse duration relative to the actual voltage applied to the print head solenoid and the driver circuits have a voltage drop of 1.5 volts, so the actual voltage applied to the print head solenoids V-SOL is V-PRINT−1.5.

Table II below shows the actual calculated values for TM compared with the manufacturer's specification for the print head

TABLE II

| V-PRINT (Volts) | V-SOL (Volts) | TX (microseconds) | Mfg. Spec. (microseconds) |
|---|---|---|---|
| 27.0 | 25.5 | 355.8 | 355.0 |
| 25.5 | 24.0 | 368.7 | 370.0 |
| 24.0 | 22.5 | 383.6 | 385.0 |

Since variations in capacitance value are eliminated from consideration of circuit operation. The accuracy of the timing operation from one manufactured circuit board to another is dependent solely on the use of accurate resistor values for the resistors involved in the timing, namely RS, R6 and R7. The cost of one percent tolerance resistors is relatively low so the advantages of this invention can be achieved at low cost. The circuit of FIG. 4 is more complex than that of the prior art circuit of FIG. 1, but the additional cost for components like the op-amp U3 is more than offset by the labor savings from avoiding a calibration and adjustment step on each printer manufactured.

It should be apparent that the circuit of FIG. 4 would also operate in a generally satisfactory manner if diode D2 were eliminated. In this case, comparator U4 and SOLEN output would not switch from LOW to HIGH until capacitor C2 was charged enough to raise the voltage at VD to equal V-REF. Since the V-PRINT voltage is not applied to a print head solenoid until SOLn goes high, this would not change the timing of the drive pulse. The design calculations would be adjusted accordingly.

FIG. 6 illustrates an alternative form of an automatic drive pulse adjust circuit in accordance with this invention. In this embodiment the PULSE signal is direct current coupled to the base of both of transistors Q3 and Q4. Transistor Q4 serves the same function as the diode D2 in the circuit of FIG. 4, namely to cause comparator U6 to switch to NIGH when PULSE goes HIGH. In other respects, the general operation of the two circuits is the same and the same design calculations would be applied to both.

FIGS. 7A–7D are an illustration of cases of the different timing of operation of the circuit of FIG. 6 for different cases of V-PRINT voltage magnitude. No attempt is made here to show any actual operation, but merely the relationship between V-PRINT magnitude and the duration of the SOLEN signal. As shown, the duration of SOLEN increases with decrease in the magnitude of V-PRINT. As with the circuit of FIG. 4, the PULSE input has a fixed duration T-R during which capacitor C6 is being charged. Thereafter, C6 is discharged with a constant current that varies directly with the magnitude of V-PRINT so that the duration of T-V varies inversely with the magnitude of V-PRINT.

The above description of different embodiments of circuits which implement the principles of this invention is given by way of example only. It should be understood that other circuits could be designed to implement the same principles. Persons skilled in this art could make numerous modifications without departing from the scope of the invention as claimed in the following claims.

What is claimed is:

1. A dot matrix printer comprising a print head having a plurality of print solenoids;

a print head carriage for carrying said print head;

carriage drive means for driving said print head carriage across a print medium;

print timing means for supplying a sequence of print timing pulses as said print head and said carriage traverse said print medium;

power supply means for supplying a print voltage;

drive pulse circuit means responsive to each of said print timing pulses for producing a solenoid enable pulse of a duration which varies inversely with the magnitude of said print voltage;

a central processing unit responding to each of said print timing pulses for supplying a set of individual solenoid address signals corresponding to dots to be printed by said print head;

driver circuit means responsive to coincidence of said solenoid enable signal and said solenoid address signals for applying said print voltage to solenoids of said print head associated with said solenoid address signals;

said drive pulse circuit means comprising:

timing means for providing a first timing interval having a prearranged start time relative to each of said print timing pulses and a prearranged duration;

first circuit means, including a capacitor, and responsive to said timing means for charging said capacitor in a first direction with a constant current of prearranged fixed magnitude for the duration of said first timing interval and thereafter discharging said capacitor to a first reference voltage of prearranged first magnitude with a constant current of magnitude varying directly with the magnitude of said print voltage to provide a second timing interval of a duration varying inversely with the magnitude of said print voltage;

second circuit means responsive to said first circuit means for producing an output pulse having a duration equal to the combined durations of said first timing interval and said second timing interval to serve as said solenoid enable pulse.

2. Apparatus as claimed in claim 1, wherein said timing means is a one shot circuit responding to a trigger signal to produce a pulse output of said prearranged duration, said central processing unit supplies said trigger signal to said one shot circuit at a prearranged time following each of said print timing pulses;

said first circuit means comprises:

an operational amplifier having said capacitor and a diode connected in parallel between the output terminal and the minus input terminal of said operational amplifier;

voltage supply means supplying said first reference voltage of said prearranged first magnitude to the plus input terminal of said operational amplifier;

a first resistor means of prearranged first resistance value connected to said minus input terminal;

a second resistor means of prearranged second resistance value connected between said first resistor means and said power supply means to receive said print voltage applied thereto;

switch means coupled to the output of said one-shot circuit and responding to said pulse output by applying a second reference voltage of prearranged second magnitude to the junction of said first and second resistor means for the duration of said pulse output, said prearranged second magnitude of said second reference voltage being less than said prearranged first magnitude of said first reference voltage;

whereby said capacitor is charged for the duration .of said pulse output with a current having a magnitude which is a function of the difference between said first and second reference voltages and said first resistance value and said capacitor is thereafter discharged with a current having a magnitude which is a function of the difference between the magnitude of said print voltage and said first reference voltage and the sum of said first and second resistance values until the voltage on the output of said operational amplifier is equal to said first magnitude less the forward voltage drop of said diode.

3. Apparatus as claimed in claim 2, wherein said second reference voltage is substantially ground reference potential;

said second circuit means comprises a comparator circuit having a plus input terminal connected to the output of said operational amplifier circuit and a minus input connected to said voltage supply means supplying said first reference voltage by way of a resistor;

and said switch means applies said second reference voltage to said minus input of said comparator circuit only for the duration of said pulse output;

whereby the output of said comparator circuit goes high at the start of said pulse and remains high for the duration of said pulse while said capacitor is being charged and for the duration of said second timing interval as said capacitor is being discharged to said first reference voltage.

4. Apparatus as claimed in claim 3, wherein said switch means comprises:

a transistor having its base electrode coupled to said one-shot circuit, its emitter electrode connected to ground reference potential and its collector electrode connected to the junction of said first and second resistor means; and a diode connected between said collector electrode and said minus input of said comparator circuit and poled to couple the collector voltage to said minus input when said collector voltage is less than said first reference voltage due to turn on of said transistor by said pulse signal from said one-shot circuit.

5. Apparatus as claimed in claim 3, wherein said switch means comprises:

first and second transistors having base electrodes coupled to said one-shot circuit, emitter electrodes coupled to ground reference potential and collector electrodes respectively and separately connected to the junction of said first and second resistor means and to said minus input terminal of said comparator circuit.

6. Apparatus as claimed in claim 1, wherein said carriage drive means includes a DC motor;

said print timing means comprises a slotted timing disc driven by said DC motor, photoelectic circuit means for detecting said slots as said timing disc rotates, and signal detect means for producing a print timing pulse in response to detection of each of said slots, each of said pulses corresponding to a dot matrix print position;

said central processing unit receives each of said print timing pulses as an interrupt signal and responds by outputting said set of solenoid address signals and a trigger pulse at predetermined times following receipt of said print timing pulse;

said timing means in said drive pulse circuit means is a one shot circuit receiving said trigger pulse and producing a pulse output of said prearranged duration; and said first circuit means comprises:

an operational amplifier having said capacitor and a diode connected in parallel between the output terminal and the minus input terminal of said operational amplifier;

voltage supply means supplying said first reference voltage of said prearranged first magnitude to the plus input terminal of said operational amplifier;

a first resistor means of prearranged first resistance value connected to said minus input terminal;

a second resistor means of prearranged second resistance value connected between said first resistor means and said power supply means to receive said print voltage applied thereto;

switch means coupled to the output of said one-shot circuit and responding to said pulse output by applying a second reference voltage of prearranged second magnitude to the junction of said first and second resistor means for the duration of said pulse output, said prearranged second magnitude of said second reference voltage being less than said prearranged first magnitude of said first reference voltage;

whereby said capacitor is charged for the duration of said pulse output with a current having a magnitude which is a function of the difference between said first and second reference voltages and said first resistance value and said capacitor is thereafter discharged with a current having a magnitude which is a function of the difference between the magnitude of said print voltage and said first reference voltage and the sum of said first and second resistance values until the voltage on the output of said operational amplifier is equal to said first magnitude less the forward voltage drop of said diode.

7. Apparatus as claimed in claim 6, wherein said second reference voltage is substantially ground reference potential;

said second circuit means comprises a comparator circuit having a plus input terminal connected to the output of said operational amplifier circuit and a minus input connected to said voltage supply means supplying said first reference voltage by way of a resistor;

and said switch means applies said second reference voltage to said minus input of said comparator circuit only for the duration of said pulse output;

whereby the output of said comparator circuit goes high at the start of said pulse and remains high for the duration of said pulse while said capacitor is being charged and for the duration of said second timing interval as said capacitor is being discharged to said first reference voltage.

8. Apparatus as claimed in claim 7, wherein said switch means comprises:

a transistor having its base electrode coupled to said one-shot circuit, its emitter electrode connected to ground reference potential and its collector electrode connected to the junction of said first and second resistor means; and a diode connected between said collector electrode and said minus input of said comparator circuit and poled to couple the collector voltage to said minus input when said collector voltage is less than said first reference voltage due to turn on of said transistor by said pulse signal from said one-shot circuit.

9. Apparatus as claimed in claim 7, wherein said switch means comprises:

first and second transistors having base electrodes coupled to said one-shot circuit, emitter electrodes coupled to ground reference potential and collector electrodes respectively and separately connected to the junction of said first and second resistor means and to said minus input terminal of said comparator circuit.

10. A method for supplying a drive pulse signal to a print solenoid drive circuit of a dot matrix printer wherein the duration of said drive pulse signal varies inversely with the magnitude of the print voltage supplied to said print solenoids, said method comprising the steps of:

supplying charge to a capacitor at a constant current level of prearranged first magnitude during a first timing interval of fixed first duration;

withdrawing charge from said capacitor at a constant current level of a second magnitude varying directly with the magnitude of said print voltage until the voltage across said capacitor reaches a fixed reference level to define a second timing interval of second duration varying inversely with said magnitude of said print voltage; and supplying a drive pulse signal to said solenoid drive circuit for the combined duration of said first timing interval and said second timing interval.

11. A method for operating a dot matrix printer having a print head with a plurality of print solenoids comprising the steps of:

carrying said print head across a print medium while producing a sequence of print timing pulses to signal dot print locations;

responding to each of said print timing pulses by supplying to selected ones of said print solenoids a print voltage for a time duration which varies with the magnitude of said print voltage by performing the steps of:

producing a timing pulse of prearranged first time duration in response to said print timing pulse;

charging a capacitor at a constant fixed current for the duration of said timing pulse;

discharging said capacitor at a constant current varying directly with the magnitude of said print voltage until the voltage across said capacitor reaches a fixed reference level, thereby defining a timing interval of a second time duration varying inversely with said magnitude of said print voltage; and supplying said print voltage to said selected solenoids for a time period equal to a prearranged portion of said first time duration and all of said second time duration.

* * * * *